US006807758B2

(12) United States Patent
Di Leta

(10) Patent No.: US 6,807,758 B2
(45) Date of Patent: Oct. 26, 2004

(54) BLOWING-TYPE AND/OR SUCTION-TYPE IRONING BOARD

(75) Inventor: Ermete Di Leta, Santa Lucia di Piave (IT)

(73) Assignee: EURO STAR S.R.L., Santa Lucia Di Piave (IT)

( * ) Notice: Subject to any disclaimer, the term of this patent is extended or adjusted under 35 U.S.C. 154(b) by 0 days.

(21) Appl. No.: 10/468,782

(22) PCT Filed: Jan. 26, 2002

(86) PCT No.: PCT/EP02/00810

§ 371 (c)(1),
(2), (4) Date: Aug. 21, 2003

(87) PCT Pub. No.: WO02/072941

PCT Pub. Date: Sep. 19, 2002

(65) Prior Publication Data

US 2004/0064980 A1 Apr. 8, 2004

(30) Foreign Application Priority Data

Feb. 23, 2001 (IT) ..... PN200100006 U

(51) Int. Cl.[7] ..... D06F 81/08
(52) U.S. Cl. ..... 38/137
(58) Field of Search ..... 38/137, DIG. 1, 38/DIG. 2, DIG. 3, 135, 138, 139; 108/116, 118

(56) References Cited

U.S. PATENT DOCUMENTS

| | | | | | |
|---|---|---|---|---|---|
| 2,331,673 | A | * | 10/1943 | Fay | 38/104 |
| 2,645,046 | A | * | 7/1953 | Frej | 38/137 |
| 5,290,998 | A | * | 3/1994 | Couch et al. | 219/247 |
| 5,669,164 | A | | 9/1997 | Voitchovsky | |
| 6,550,164 | B2 | * | 4/2003 | Rosa | 38/137 |
| 6,655,055 | B2 | * | 12/2003 | Loger et al. | 38/137 |

FOREIGN PATENT DOCUMENTS

| | | |
|---|---|---|
| CH | 373344 | 11/1963 |
| EP | 0531207 A1 | 3/1993 |
| EP | 0712955 A2 | 5/1996 |
| EP | 0712955 B1 | 5/1996 |
| EP | 0713938 A1 | 5/1996 |

* cited by examiner

*Primary Examiner*—Ismael Izaguirre
(74) *Attorney, Agent, or Firm*—Wenderoth, Lind & Ponack, L.L.P.

(57) ABSTRACT

The ironing board comprises a perforated worktop (1) enclosed by a casing (2) with which it defines a chamber (3) associated to ventilation means for the steam ejected by an iron to pass therethrough. The ironing board further comprises adjustable support legs (8, 9), whose upper end portions are connected directly to the worktop (1). At least one (9) of these legs is adapted to pass in an air-tight manner through a longitudinal aperture (20) provided in the casing (2).

6 Claims, 2 Drawing Sheets

BLOWING-TYPE AND/OR SUCTION-TYPE IRONING BOARD

BACKGROUND OF THE INVENTION (1) Field of the Invention

The present invention refers to an ironing board, in particular for steam-assisted ironing, of the type in which air and/or steam are caused to be blown out and/or sucked in through a perforated ironing top surface of the ironing board.

(2) State of the Prior Art

Ironing boards of the above cited kind are largely known in the art. For instance, U.S. Pat. No. 5,669,164 discloses an ironing board associated with an iron. A fan is mounted below the ironing top surface of such a board and this fan is operated so as to rotate either in a direction or in the opposite one so as to generate a negative pressure or a positive pressure in a chamber provided under the board; while the steam is ejected from the iron.

EP-A-0531 207 describes an ironing board whose top surface is provided with valves that are adapted to establish a communication between such a top surface and a ventilated chamber arranged therebelow. These valves are operated when the iron passes thereupon.

GB-A-2 226 830 describes an ironing board in the worktop of which there are provided suction zones and pressure or blowing zones for the air that is circulated by means of a fan, in order to keep the clothes being ironed closely adhering against the board.

JP-B-3 051 091 describes an ironing board that is associated with a steam iron. The steam accumulates in a chamber arranged below the worktop of the board and a humidity sensor, on the basis of a pre-established value, controls the moisture in the chamber and triggers steam suction, i e. causes the steam to be sucked in through the ironing top surface accordingly.

Ventilated ironing boards of the above cited kind are usually provided with a substantially rigid working, i.e. an ironing top surface made of perforated sheet-metal or metal net covered with a transpiring cloth and associated with a lower casing provided therebeneath, which defines and encloses a chamber for the steam to flow therethrough. This chamber collects any possible condensation water and is connected to a motor-driven fan adapted to support the circulation of the steam ejected from the steam iron through the ironing top surface. In substance, it is the presence of such a lower casing and such a fan that makes the real difference between blowing and/or suction-type ironing boards and the traditional ones.

Connected to the lower casing there are at least a pair of folding support legs that are articulated in a scissors-like manner. In particular, the upper end portion of one of such legs is hinged on to the casing, to which there is attached also a longitudinal runner provided with ratchets for corresponding detents, along which the upper end portion of the other leg is capable of sliding in an adjustable manner, so as to correspondingly vary the height of the ironing top surface with respect to the floor.

The casing must therefore sustain the entire ventilated ironing board, which is largely known to be quite heavy, so that it must be fabricated of an adequately strong and robust material, usually a metal. It must further be adequately stiffened and must be provided with proper means adapted to allow for the legs to be properly hinged thereon and to slide longitudinally in a guided manner therealong. As a result, such a casing turns out to be undesirably toilsome, i.e. demanding and expensive to fabricate, and must be given a relatively complex structure that contributes to increasing the overall weight of the ironing board, so that the latter also proves considerably less convenient in practical use.

OBJECT AND SUMMARY OF THE INVENTION

It therefore is a main purpose of the present invention to provide a suction-type and/or blowing-type ironing board that has a particularly simple and light-weight structure, which therefore proves low-cost and is convenient in use.

According to the present invention such an aim is reached in an ironing board of the blowing-type and/or suction-type embodying the features as recited in the appended claims.

In particular, according to the present invention the casing is reduced to an element having a mere enclosing purpose, while the ironing top is given a self-bearing construction by connecting it directly to the support legs.

BRIEF DESCRIPTION OF THE DRAWINGS

Features and advantages of the present invention may be more readily understood from the description that is given below by way of non-limiting example with reference to the accompanying drawings, in which.

DETAILED DESCRIPTION OF THE PREFERRED EMBODIMENT

Figure 1:
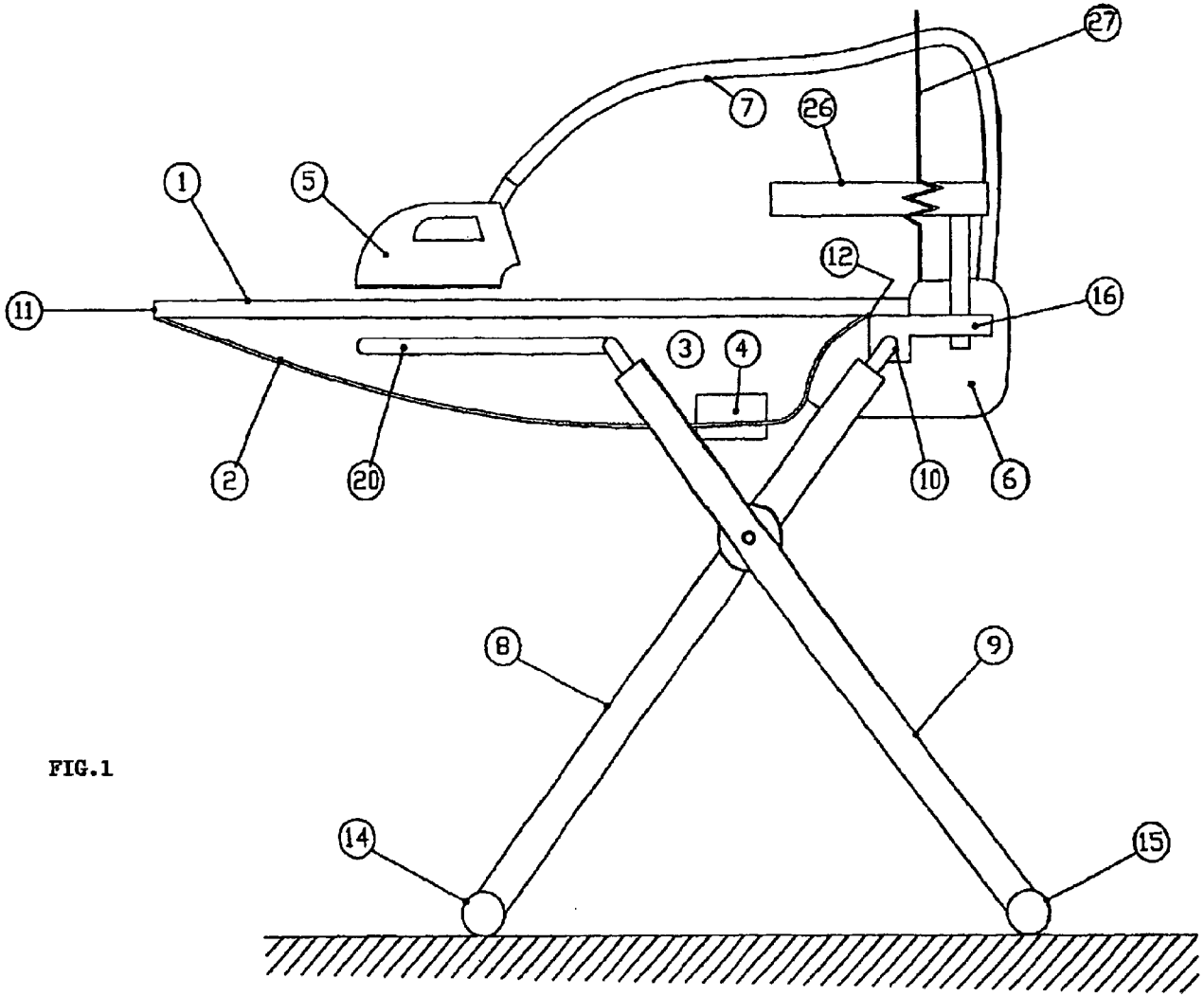
FIG. 1 is a schematical side view of a preferred embodiment of the ironing board according to the present invention, under normal conditions of use thereof.

With reference to the Figures, the ironing board is preferably of the steam-assisted type and comprises mainly a substantially rigid worktop 1 of perforated sheet-metal or metal net, to the lower side of which there is attached an appropriately shaped casing 2 that defines, jointly with the worktop 1 itself, a chamber 3 for the steam to flow therethrough.

The chamber 3 is ventilated by a motor-operated fan 4 of the suction type and/or blowing type, which is adapted to promote the circulation, through the worktop 1, of the steam ejected by a smoothing iron 5. In an inherently known manner, such steam is generated by a boiler 6 that is mounted on the rear side of the ironing worktop 1 and is connected to the smoothing iron 5 via an appropriate conduit 7.

The ironing board is of the type that is capable of being adjusted in its height by means of at least a pair of folding legs 8, 9 that are articulated in a scissors-like manner.

Preferably, the upper end portion of one of these legs (indicated at 8) is hinged on to the worktop 1 at 10, in correspondence of a zone of the lower surface thereof that extends rearwards beyond the casing 2 in the form of a rigid bracket 16 or the like. As a matter of fact, the casing 2 preferably extends from the front end portion 11 of the ironing board up to a rear end portion 12 beyond which the leg 8 is hinged on to the worktop 1.

Inside the chamber 3, the worktop 1 is provided on its lower surface with a longitudinal runner 13 (FIG. 2), preferably provided with adjustment ratchets or detents, along which the upper end portion of the other leg (indicated at 9) is capable of sliding. In the preferred example of embodiment that is described here, both legs 8 and 9 extend in correspondence of a single side of the ironing board and are provided with respective transversal floor-resting bases 14 and 15.

Figure 2:
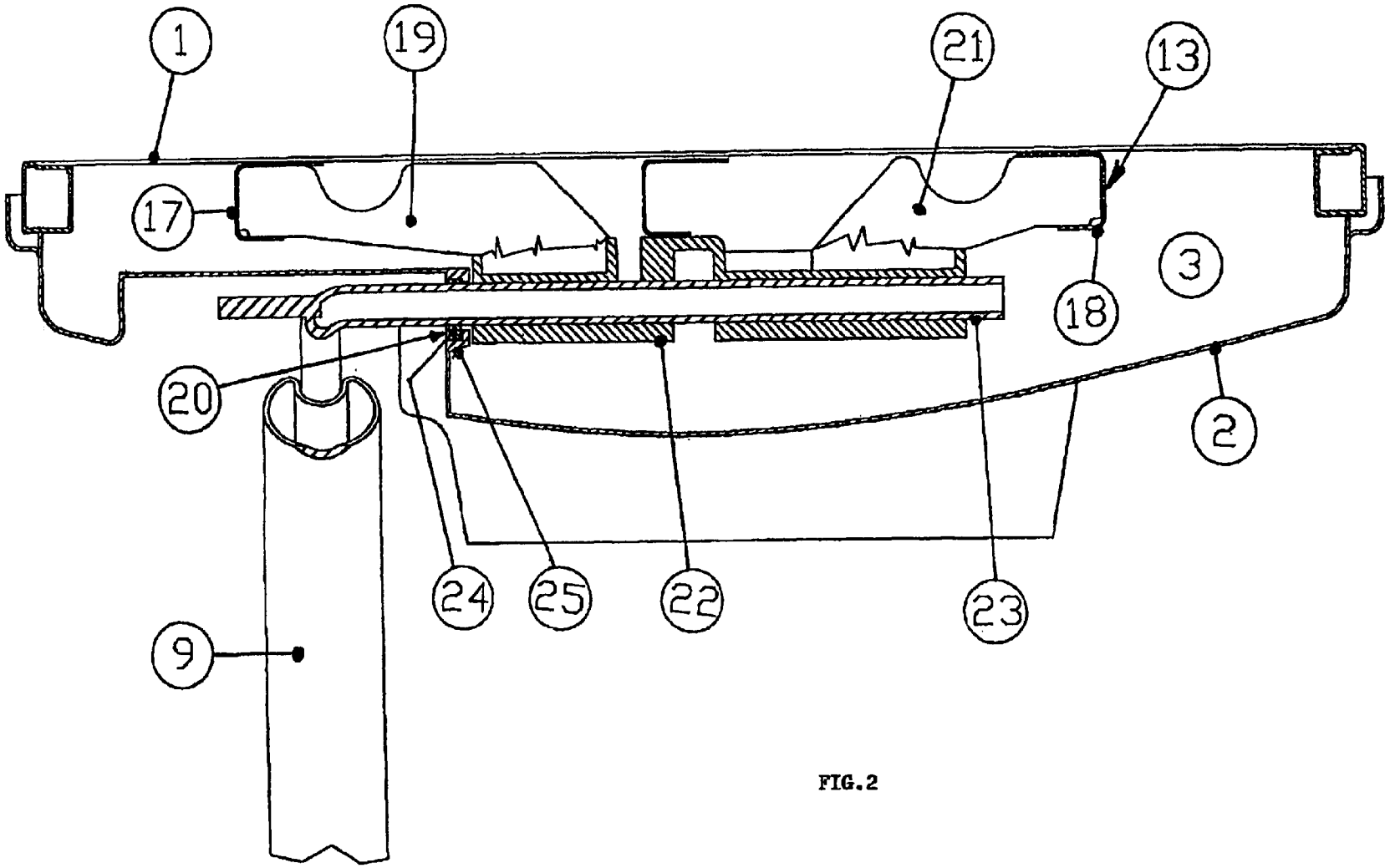
FIG. 2 is a partial, enlarged-scale cross-sectional view of the ironing board illustrated in FIG. 1.

With reference to FIG. 2, the longitudinal runner 13 is preferably formed by two mutually opposing, C-shaped profile sections 17, 18 attached to the lower surface of the worktop 1. Fitting in slidably between the two profile sections 17, 18 there are respective appropriately shaped flanges 19, 21 attached to a transversal bush, or slide, 22 into which there is fitted a pin 23 that extends in a substantially horizontal manner from the upper end portion of the leg 9.

In an inherently known manner, the longitudinal sliding motion of the pin 23 with respect to the runner 13, along with the scissors-like articulation of the legs 8, 9, enables the worktop 1 to be adjusted in its working height, as well as the legs themselves to be fully folded up against the same worktop 1 in such a position as to enable the ironing board to be conveniently stored under minimum space requirements.

The leg 9, and in particular the pin 23, fits into the bush 22 by passing through a longitudinal aperture 20 provided in the casing 2, preferably in correspondence of the side surface thereof, as illustrated in connection with the example of embodiment that is being described.

A filling or plugging lug or strip 24, or the like, enables the support leg 9 to be displaced with respect to the aperture 20, while at the same time keeping the same aperture substantially closed, so as to avoid affecting or altering the suction and/or blowing effect of the fan 4 through the ventilated chamber 3.

In particular, the lug or strip 24 is adapted to slide longitudinally along an auxiliary runner 25 provided in correspondence of the border of the aperture 20 and is integral with the pin 23 in the longitudinal displacements thereof.

Conclusively, this advantageously enables the steam-assisted ironing board to keep operating in an optimum manner, while on the other hand setting the casing 2 free from any structural stiffening and/or support task.

As a matter of fact, the hinging means used for the legs 8, 9, as well as the sliding runner 13, are in all cases attached to the worktop 1, which therefore turns out to be self-bearing.

The casing 2, on the contrary, performs as a mere enclosure to contain and delimit the ventilated chamber 3, so that it can most easily be manufactured out of any suitable lightweight and low-cost material, without any particular structural constraint.

It will be readily appreciated that the above described ironing board may be the subject of a number of modifications without departing from the scope of the present invention.

So, by mere way of example, the use may be envisaged of two pairs of legs 8, 9, or the aperture 20 may be provided in a lower position in the casing 2 and the sealing or plugging means 24 may be provided with any different structure as far as this suits the application.

In any case, the ironing board will be preferably completed by a surface or shelf 26, attached to the worktop 1, for the smoothing iron 5 to be put to rest thereupon. It will further comprise a power-supply cable 27 for powering the various operating elements of the apparatus.

It shall further be readily appreciated that, as an alternative to the afore described example, the ironing board according to the present invention may be of a suction type and/or blowing type that does not include a steam-generation function of its own, so that the boiler 6 may be omitted along with the various operating elements associated therewith.

What is claimed is:

1. An ironing board, comprising:

a perforated substantially rigid work top which is enclosed on an inferior side thereof by a casing, said casing and said work top defining a chamber for steam ejected by a smoothing iron, which steam can pass through said work top to said chamber; and a pair of adjustable support legs for supporting said work top, said adjustable support legs each having an upper end portion connected to said ironing board, wherein one of said support legs passes through a longitudinal aperture in said casing and said longitudinal aperture extends substantially parallel to a plane of said work top such that the one of said support legs can slide longitudinally along said aperture parallel to the plane of said work top.

2. The ironing board of claim 1, wherein a guide is attached to a lower surface of said work top inside said chamber and the one of said support legs is adapted to slide longitudinally along said guide.

3. The ironing board of claim 2, wherein said longitudinal aperture extends on one side of said casing and the one of said support legs comprises a pin on said upper end portion thereof passing through said aperture in a direction substantially parallel with said plane of said work top.

4. The ironing board of claim 1, wherein said aperture has a seal or plug adapted to enable the one of said support legs to slide longitudinally along said aperture while maintaining said aperture substantially closed.

5. The ironing board of claim 4, wherein said seal or plug comprises a plugging lug or strip connected to the one of said support legs so that it can slide longitudinally with the one of said support legs to maintain said aperture substantially closed.

6. An ironing board comprising:

a work top having a perforated surface;

a casing on an underside of said work top forming a chamber with said work top for steam when steam is ejected from smoothing iron;

a longitudinal aperture in said casing extending parallel to said work top; and a pair of support legs, one of said support legs having an upper end arranged to pivot relative to said work top, and the other of said support legs having an upper end arranged to slide longitudinally in said longitudinal aperture.

* * * * *